United States Patent [19]

Keritsis et al.

[11] Patent Number: 4,510,950

[45] Date of Patent: Apr. 16, 1985

[54] FOAMED, EXTRUDED, TOBACCO-CONTAINING SMOKING ARTICLE AND METHOD OF MAKING SAME

[75] Inventors: Gus D. Keritsis; Walter A. Nichols, both of Richmond, Va.

[73] Assignee: Philip Morris Incorporated, New York, N.Y.

[21] Appl. No.: 457,505

[22] Filed: Dec. 30, 1982

[51] Int. Cl.[3] ..... A24B 3/14

[52] U.S. Cl. ..... 131/353; 131/358; 131/369; 131/375; 131/77; 131/78; 131/79; 131/364

[58] Field of Search ..... 131/309, 310, 352–358, 131/364, 369–375, 77–79

[56] References Cited

U.S. PATENT DOCUMENTS

| | | | |
|---|---|---|---|
| 235,886 | 12/1880 | Lindsley | 131/370 |
| 2,433,877 | 1/1948 | Wells et al. | 131/370 |
| 2,445,338 | 7/1948 | Sowa | 131/370 |
| 2,485,670 | 10/1949 | Sowa et al. | 131/370 |
| 2,592,553 | 4/1952 | Frankenburg et al. | 131/370 |
| 2,598,680 | 6/1952 | Frankenburg | 131/370 |
| 3,085,580 | 4/1963 | Muth | 131/370 |
| 3,098,492 | 7/1963 | Wurzburg et al. | 131/370 |
| 3,203,432 | 8/1965 | Green et al. | 131/370 |
| 3,209,763 | 10/1965 | Parmele et al. | 131/370 |
| 3,223,090 | 12/1965 | Strubel et al. | 131/370 |
| 3,353,541 | 11/1967 | Hind et al. | 131/370 |
| 3,364,935 | 1/1968 | Moshy et al. | 131/370 |
| 3,373,751 | 3/1968 | Wallberg | 131/370 |
| 3,404,691 | 10/1968 | Moshy et al. | 131/370 |
| 3,410,279 | 11/1968 | Moshy et al. | 131/370 |
| 3,528,434 | 9/1970 | Halter et al. | 131/370 |
| 3,529,602 | 9/1970 | Hind et al. | 131/370 |
| 3,820,548 | 6/1974 | Buchmann et al. | 131/359 |
| 3,894,544 | 7/1975 | Egri | 131/370 |
| 3,931,824 | 1/1976 | Miano et al. | 131/359 |
| 3,932,081 | 1/1976 | Buchmann et al. | 131/370 |
| 4,233,993 | 11/1980 | Miano et al. | 131/357 |
| 4,333,484 | 6/1982 | Keretsis | 131/359 |
| 4,340,072 | 7/1982 | Bolt et al. | 131/370 |
| 4,347,855 | 9/1982 | Lanzillotti et al. | 131/370 |
| 4,391,285 | 7/1983 | Burnett et al. | 131/370 |

FOREIGN PATENT DOCUMENTS

| | | |
|---|---|---|
| 1167717 | 4/1964 | Fed. Rep. of Germany . |
| 275420 | 9/1949 | Switzerland . |
| 282369 | 11/1927 | United Kingdom . |
| 2064296 | 6/1981 | United Kingdom . |

OTHER PUBLICATIONS

Defensive Publication T912,011, Harpham et al., Published Jul. 24, 1973.

*Primary Examiner*—V. Millin

[57] ABSTRACT

A substantially cylindrical foamed, extruded, tobacco-containing smoking article is provided which has properties substantially equivalent to those of a conventional cigarette and which contains from about 5 to about 98 wt. % of tobacco particles having a particle size of up to about 5 mesh, from 0 to about 60 wt. % of a filler having a particle size of up to about 350 μm mesh, from about 2 to about 40 wt. % of a cellulosic binder selected from the group consisting of hydroxypropyl cellulose, carboxymethyl cellulose, and its sodium, potassium and ammonium salts, cross-linked carboxymethyl cellulose, and its sodium, potassium and ammonium salts, hydroxyethyl cellulose, ethyl hydroxyethyl cellulose, hydroxypropyl methyl cellulose, methyl cellulose, ethyl cellulose, and mixtures thereof, and from about 5 to about 20 wt. % water. The article has a density within the range of from about 0.05 to about 1.5 g/cc. The method of making such articles comprises the steps of (a) dry blending from about 5 to about 98 wt. % of the tobacco particles having an OV value of from about 3 to about 20%, with from 0 to about 60 wt. % of a filler and having a particle size of up to about 5 mesh, and from about 4 to about 40 wt. % of the cellulosic binder; then (b) admixing this dry blend with water to form a wet blend containing from about 15 to about 50 wt. % of water; then (c) extruding the wet blend under extrusion conditions of temperature and pressure such that as the wet blend is extruded the moisture in the blend is converted to steam thereby foaming the article.

17 Claims, No Drawings

FOAMED, EXTRUDED, TOBACCO-CONTAINING SMOKING ARTICLE AND METHOD OF MAKING SAME

BACKGROUND OF THE INVENTION

The present invention relates to tobacco-containing smoking articles and a method of making same. More particularly, the present invention relates to foamed, extruded, tobacco-containing smoking articles and to a method of making such articles.

It is known to make non-foamed, extruded, tobacco-containing smoking articles such as are disclosed in commonly assigned, co-pending application Ser. No. 148,124, filed May 9, 1980. The tobacco-containing smoking articles disclosed in that application are articles wherein tar delivery during combustion is controlled by adjusting the density, porosity, surface area or composition of the article. The article comprises a coherent mass of combustible tobacco-containing material having at least one through passage extending from a first opening in the surface of the mass to a second opening, remote from the first. The coherent mass is of a density and porosity such as to substantially occlude gas flow through the mass, while also being of a porosity sufficient to support combustion of the mass when ignited.

A method of making the smoking articles of application Ser. No. 148,124 is disclosed in commonly assigned U.S. Pat. No. 4,347,855 which issued Sept. 7, 1982. According to this method, a combustible tobacco material is mixed with one or more other ingredients, including a liquid, to provide a tobacco mixture which is then shaped under pressure into a discrete coherent mass; at least one passage is provided through the mass, and then the mass is dried. The mixture composition is selected and the shaping pressure and drying are controlled to impart to the mass a density and porosity such as to substantially occlude gas flow therethrough, and a porosity sufficient to support combustion of the shaped mass when it is ignited.

Formation of the coherent mass is preferably effected by extrusion of the tobacco mixture, which, for this purpose, preferably contains comminuted tobacco of mesh size less than about 30 mesh, and in an amount sufficient to provide a solids content in the mixture of from about 55 to about 75 weight percent. The burn characteristics of the tobacco article produced according to this method are improved by further processing the dry and coherent mass by re-wetting and subsequently re-drying the mass.

Commonly assigned U.S. Pat. No. 4,333,484, which issued June 8, 1982, discloses a modified cellulosic smoking material and a method for its preparation. The material does not contain tobacco and affords reduced particulate matter and puff count while having the flavor and aromatic qualities of natural tobacco. The smoking material comprises cellulosic material having incorporated therein a metal salt selected from the group consisting of calcium salts, magnesium salts, iron salts, and aluminum salts of various organic or inorganic acids. The cellulosic material is preferably selected from the group consisting of carboxymethyl cellulose and its salts, cross-linked carboxymethyl cellulose and its salts, methyl cellulose, hydroxypropyl methyl cellulose, hydroxypropyl cellulose, ethyl cellulose, ethyl hydroxyethyl cellulose, hydroxyethyl cellulose, and combinations thereof.

The method of making the smoking article comprises forming an aqueous slurry of the cellulosic material, preferably in the form of loose and slightly beaten cellulose fibers, adding from about 5 to 40 percent by weight, based on the cellulosic material, of the metal salt; adding a foaming or blowing agent to the resulting slurry under conditions which do not allow the foaming or blowing agent to foam the slurry; and casting or extruding the slurry and than drying the cast or extruded slurry under such conditions wherein the slurry is foamed during the casting or extruding step or during the drying step.

The organic acid is preferrably selected from the group consisting of formic acid, acetic acid, propionic acid, butyric acid, valeric acid, methylvaleric acid, isovaleric acid, hexanoic acid, heptanoic acid, octanoic acid, benzoic acid, phenylacetic acid, citric acid, malic acid, tartaric acid, gluconic acid, and malonic acid and its lower alkyl derivatives, and combinations thereof. The inorganic acid is selected from the group consisting of hydrochloric acid, sulfuric acid, phosphoric acid, carbonic acid and combinations thereof.

The slurry may also include from about 3 to 40 percent by weight of an additive selected from the group consisting of pectins and their sodium, potassium, ammonium, calcium or magnesium salts, alginic acid and its sodium, potassium, ammonium, calcium or magnesium salts, and combinations thereof.

The foaming agent is preferably added to the slurry while the slurry is under sufficient pressure to prevent premature foaming of the slurry. The foaming agent is selected from the group consisting of air, steam, inert gases, volatile hydrocarbons, and combinations thereof. Preferably, the foaming agent is selected from a group consisting of ammonium carbonate, ammonium carbamate, azides, hydrazides, peroxides, azodicarbonamide, and combinations thereof.

Among the objects of the present invention are the following:

to provide a foamed, extruded, tobacco-containing smoking article which exhibits superior combustion properties and taste, as compared to those smoking articles produced by the aforementioned methods;

to provide a method of making such foamed, extruded, tobacco-containing smoking articles.

SUMMARY OF THE INVENTION

A substantially cylindrical, foamed, extruded, tobacco-containing smoking article is provided which has properties substantially equivalent to those of a conventional cigarette and which comprises from about 5 to about 98 wt. % tobacco particles having a particle size of up to about 5 mesh, from 0 to about 60% of a filler having a particle size of up to about 350 μm, from about 5 to about 20 wt. % water, and from about 2 to about 40 wt. % of a cellulosic binder selected from the group consisting of hydroxypropyl cellulose, carboxymethyl cellulose, and its sodium, potassium and ammonium salts, cross-linked carboxymethyl cellulose, and its sodium, potassium and ammonium salts, hydroxyethyl cellulose, ethyl hydroxyethyl cellulose, hydroxypropyl methyl cellulose, methyl cellulose, ethyl cellulose, and mixtures thereof; preferably hydroxypropyl cellulose, carboxymethyl cellulose or both. The article has a density within the range of from about 0.05 to about 1.5 g/cc, and a preferred diameter within the range of from about 2 to about 35 mm.

The article may also include from about 0.1 to about 15 wt. % of a polyfunctional acid, preferably citric acid, from about 0.001 to about 1 wt. % of an alcohol selected from the group consisting of ethanol, methanol, isopropanol, n-propanol and mixtures thereof, preferably ethanol, and may also desirably include from about 0.1 to about 40 wt. % of a cross-linked stiffening agent.

A method of making such a foamed, extruded, tobacco-containing smoking article is also provided and comprises the steps of (a) dry blending from about 5 to about 98 wt. % of comminuted tobacco particles having a particle size of up to about 5 mesh and an OV value of from about 3 to about 20%, with from 0 to about 60 wt. % of a filler having a particle size of up to about 350 μm, and from about 2 to about 40 wt. % of the cellulosic binder; then (b) admixing this dry blend with water to form a wet blend containing from about 15 to about 50 wt. % of water; then (c) extruding the wet blend from step (b) under extrusion conditions of temperature and pressure such that as the wet blend is extruded, the moisture in the wet blend is converted to steam, thereby foaming the article.

DESCRIPTION OF THE PREFERRED EMBODIMENTS

The foamed, extruded, tobacco-containing smoking articles of the present invention contain, as essential ingredients, tobacco particles, water, and a cellulosic binder selected from the group consisting of hydroxypropyl cellulose, carboxymethyl cellulose, and its sodium, potassium and ammonium salts, cross-linked carboxymethyl cellulose, and its sodium, potassium and ammonium salts, hydroxyethyl cellulose, ethyl hydroxyethyl cellulose, hydroxypropyl methyl cellulose, methyl cellulose, ethyl cellulose, and mixtures thereof; preferably hydroxypropyl cellulose.

As the tobacco particles, comminuted tobacco selected from the group consisting of bright, burley, oriental, and mixtures thereof, comminuted reconstituted tobacco, comminuted stems, and tobacco dust or fines, may be employed. The tobacco may have been previously subjected to a stiffening or expansion process to increase its filling power. The smoking article comprises from about 50 to about 98 wt. % of the tobacco particles.

Whatever the source of the tobacco particles, the particles employed in the present invention will have a particle size of up to about 5 mesh. Preferably, the particle size will be less than 35 mesh, and more preferably will be less than 50 mesh. When particle sizes greater than 35 mesh are employed, it is desirable and may be necessary to add a polyfunctional acid, such as citric acid, during formation of the article in order to achieve the desired appearance and foaming of the extruded article. The polyfunctional acid is added in an amount such that the smoking article contains from about 0.1 to about 15 wt. % thereof, preferably from about 2 to about 10 wt. %.

The article may also include a filler, which is any particulate material having a particle size of up to about 350 μm and which is compatible with the other components of the blend. The filler is preferably selected from the group consisting of calcium carbonate, magnesium carbonate, calcium oxide, magnesium oxide, calcium hydroxide, magnesium hydroxide, alumina, hydrated alumina, clay, silica and mixtures thereof; preferably calcium carbonate. When the filler is added, it is added in an amount within the range of from about 5 to about 50 wt. % and the tobacco particles are added in an amount within the range of from about 5 to about 98 wt. %, preferably from about 25 to about 98 wt.%.

The cellulosic binder is present in an amount of from about 2 to about 40 wt. %, preferably from about 2 to about 30 wt. %. The cellulosic binder is preferably selected from the group consisting of hydroxypropyl cellulose, carboxymethyl cellulose, and hydroxyethyl cellulose, and mixtures thereof. A mixture of carboxymethyl cellulose and hydroxypropyl celluose is particularly preferred.

A portion of the cellulosic binder may be substituted with a compound (hereinafter "the compound") selected from the group consisting of pectin and its sodium, potassium and ammonium salts, guar, starch, hemicellulose, curdlan, a salt of xanthamonas gum, carageenan, oxycellulose, polyvinyl alcohol, vinyl maleic anhydride polymer, a vinyl maleic acid polymer, and its sodium, potassium, and ammonium salts, microcrystalline cellulose, fibrous cellulose, and mixtures thereof, such that the total amount of the compound plus the cellulosic binder falls within the ranges given for the cellulosic binder.

The smoking article contains from about 5 to about 20 wt. % water, which is typically measured as oven volatiles (OV). Preferably, the smoking article contains from about 8 to about 17 wt. % water. This water, or moisture content, is selected in conjunction with the other weight ranges of additives in order to achieve the optimum degree of firmness and the optimum burn properties.

The smoking articles of the present invention have a density within the range of from about 0.05 to about 1.5 g/cc, preferably from about 0.10 to about 1.0 g/cc. The articles are foamed and thus comprise a porous structure which permits static burning and which also permits the passage of smoke through the article to the smoker without the provision of any passages through the article. The density of the article is related to the porous structure, and articles having densities within these ranges provide the optimum burn rate and transmission of smoke to the smoker.

The smoking articles may also include from about 0.001 to about 1 wt. % of an alcohol compatible with the cellulosic binder, that is, an alcohol in which the cellulosic binder is soluble, and which is selected from the group consisting of ethanol, methanol, isopropanol, n-propanol and mixtures thereof. The alcohol present in the smoking article is residual and results from a preferred practice of adding the alcohol during the formation of the article in order to lower the moisture content of the extrudate at the die, which provides a firmer, more easily handled product that requires less drying.

The smoking article may also contain from about 0.1 to about 40 wt. %, preferably from about 0.5 to about 20 wt. %, of a cross-linked stiffening agent. The stiffening agent which is added prior to extrusion and then cross-linked during extrusion is selected from the group consisting of alginic acid, pectinic acid, chitosan, water soluble salts thereof, and mixtures thereof.

The smoking articles are preferably formed as substantially cylindrical rods having a diameter within the range of from about 2 to about 35 mm, preferably from about 4 to about 25 mm. These rods are typically made in conventional cigarette or cigar lengths and may be wrapped with cigarette paper, a cigar wrapper, or the like. The articles may be thus marketed as non-filtered "cigarettes" and as "cigars". A conventional filter may be joined to the "cigarette" by tipping paper to form a filtered smoking article.

Various flavorants, humectants, or both which are typically employed in the manufacture of smoking articles, may be added prior to extrusion or may be subsequently added to the foamed, extruded article before it is processed into a commercial product.

The method of the present invention comprises three essential steps, which are: (a) dry blending tobacco particles with the binder and, optionally, the filler; then (b) admixing this dry blend with water to form a wet blend; and (c) extruding the wet blend under extrusion conditions of temperature and pressure such that as the wet blend is extruded the moisture in the blend is converted to steam thereby foaming the article as it exits the die of the extruder. As a preferred additional step (d), the extruded product of step (c) is sized to a substantially cylindrical shape having a diameter of from about 2 to about 35 mm.

In step (a), tobacco particles having a particle size of up to about 5 mesh and an OV value of from about 3 to about 20%, are dry blended with the filler and the binder. While particle sizes larger than about 35 mesh can be employed, the use of such particles makes it desirable, and in some instances necessary, to employ from about 0.1 to about 15 wt. % of a polyfunctional acid such as citric acid. The polyfunctional acid acts to soften the tobacco particles, producing a more homogenous and elastic mixture. The polyfunctional acid may also be employed for the same purpose with mixtures using smaller particle sizes, but is not required. The polyfunctional acid is preferably selected from the group consisting of citric acid, malic acid, tartaric acid, ethylene diamine tetraacetic acid, phosphoric acid, malonic acid and its $C_1$ to $C_4$ alkyl derivatives, and the sodium, potassium and ammonium salts of said acids. It is preferred to use particle sizes less than 35 mesh, and particularly preferred to use particle sizes of less than 50 mesh.

As the tobacco particles, any of the possible sources noted in connection with the discussion of the smoking article may be effectively employed. It is essential that the tobacco particles have an OV value within the range of from about 3 to about 20%, preferably from about 8 to about 17%. Thus when tobacco dust is used as the tobacco particle component of the dry blend, it may be necessary to add an amount of water during the dry blending step sufficient to achieve the required moisture content.

The cellulosic binder is present in the dry blend in an amount within the range of from about 2 to about 40 wt. %, preferably from about 4 to about 30 wt. %. The optimal amount within these ranges will vary with the specific cellulosic binder used. For example, when hydroxypropyl cellulose is used as the only cellulosic binder, an optimal amount is at least about 8 wt. %. When hydroxypropyl cellulose is not included, an optimal amount of another cellulosic binder is at least about 15 wt. %. When hydroxypropyl cellulose is used in combination with another cellulosic binder, an optimal amount of hydroxypropyl cellulose is at least about 2 wt. % in combination with at least 2 wt. % of the other cellulose binder(s) for a total amount within the range of from 4 to about 40 wt. %. A portion of the cellulosic binder may be substituted with one of the above compounds, provided that the total amount of cellulosic binder and compound is within the above ranges.

An alcohol selected from the group consisting of ethanol, methanol, isopropanol, n-propanol, and mixtures thereof may be added to the mixture in the extruder or during the dry blending step, in an amount of from about 2 to about 40 wt. %, preferably from about 5 to about 15 wt. %, in order to lower the moisture content of the extrudate at the die. This lowered moisture content has been found to correlate with a firmer product, which is more easily handled and requires less drying.

In some instances, it may also be desirable to add a stiffening agent during the dry blending step to produce a firmer product. The stiffening agent is added in the dry blending step in an amount within the range of from about 0.1 to about 40 wt. %, preferably from about 0.5 to about 20 wt. %, and is selected from the group consisting of alginic acid, pectinic acid, chitosan, their water soluble salts, and mixtures thereof. Alginic acid is preferred. The stiffening agents cross link in the presence of heat with each other or with various cross-linking agents well known to those skilled in the art which are either present in the blend or which may be added for this specific purpose. By way of example, both alginic acid and pectinic acid will cross link with chitosan as well as with polyvalent metal ions as calcium, and with amides. Chitosan will cross link with polyfunctional acids such as citric acid. These stiffening agents have been found to have the beneficial property of contributing to the subjective character of the smoke and thus may also be considered as flavorants. Although it is preferred to add these agents during the dry blending step, they may also be added during the wet blending step (b) or immediately subsequent thereto.

Once the cellulosic binder, the filler and the tobacco particles have been dry blended in step (a), which may be carried out in any conventional mixing device, the dry blend is then admixed in step (b) with water to form a wet blend containing from about 15 to about 50 wt. % of water. Step (b) is carried out in a conventional mixing device, such as a horizontal mixing cylinder, and it is preferred to employ a low shear mixer. The amount of water present in the wet blend is critical in that if the water content is reduced to less than about 15 wt. %, shear at the die increases to the point that the surface of the extruded product becomes porous and rough, which results in a less than desirable degree of foaming. At water contents in excess of about 50 wt. %, without alteration of temperature, insufficient energy is supplied to the formulation to generate foam formation as the product exits the die.

Optionally, in step (a), in step (b) or in step (c), a foaming agent may be added to the blend. The foaming agent is preferably selected from the group consisting of air, nitrogen, carbon dioxide, ammonium carbonate, ammonium carbamate, an azide, a hydrazide, pentane, hexane, heptane, a halogenated fluorocarbon, pyrrole, acetone, ethanol, a peroxide, and azodicarbonamide. Some of these foaming agents require the addition of an acid.

In step (c), the wet blend is fed into an extruder and processed as set forth in greater detail below. The wet blend is extruded under extrusion conditions of temperature and pressure such that as the wet blend is extruded, the moisture in the blend is converted to steam, thereby foaming the article. Preferred extruders include single screw cooking extruders, which are high temperature/short time extruders that are essentially Archimedean pumps and which have heretofore been employed in the food industry, hydraulic piston extruders, ram extruders, and extruders employing an extrusion chamber consisting of a male auger and a sleeve which incorporates a female auger, a spacer ring, and a face plate (or die) to shape the foamed product. It is important that the tobacco particles, the cellulose binder, and any preferred additional ingredients be mixed to form a homogeneous mixture prior to introduction into the feeding bin of the extruder.

The feeding bin is a starting point common to all extruder systems and is typically located near the extruder with its purpose being to provide a continuous source of raw ingredients. The feeding bin receives material from a conventional mixer/surge system and it typically discharges into a variable speed metering-/feeding device. A simple gravity bin with a bottom discharge suffices for the ingredients employed in the dry blending step (a).

A variable speed metering/feeding device is typically employed to take the dry blend away from the feeding bin and to transport it toward the extruder. This variable speed feeding device is a key link in the output of the extruder and sets the extrusion rate. Vibratory feeders and variable speed screw feeders are two commonly used metering/feeding devices.

An intermediary processing device, typically a horizontal mixing cylinder with either a single shaft or twin counter-rotating shafts, is utilized to admix the water with the dry blend in step (b). Continuous mixing of the dry blend with the water is accomplished in the cylinder, and from this cylinder the wet blend is fed directly into the extruder barrel. While in the barrel, the product is referred to as "extrudate."

While the feeding bin, variable speed metering/feeding device, and mixing cylinder are all of prime importance, the extruder itself is the article of the total system which fulfills the ultimate objective of working and shaping the product.

The method will be further described with reference to a single screw extruder although other types of extruders may be effectively employed.

The product is transported through the extruder barrel by the extruder screw, complemented by the closure around the screw which is referred to as the "head." The extruder head is jacketed, with the jacket being suitable for either electrical heating or the circulation of water, steam or other liquid thermofluid. This jacketing permits minor adjustments in the temperature profile of the extruder barrel by, for example, controlling the flow of the thermo-fluid within the head jacket. The vast majority of the thermoenergy within the extruder is created by the conversion of the mechanical energy into heat, but the use of jackets can give an added control and versatility feature.

It is preferred to establish and maintain a temperature gradient which increases along the length of the extruder barrel to a maximum at or just before the die within the range of from about 10° to about 300° C., more preferably about 50° to about 250° C. Thermocouples are typically installed through the head and into the product flow channel and are connected to either temperature indicators or to automatic temperature control systems for added control.

The extruder barrel may be built in segments or sections with the individual screws being separated by shear locks, which give each section its own discrete processing capability. Within the feed zone of the extruder barrel, the raw material exists as discrete particles. As these particles are transported forward in the feed zone, there is a positive pumping action with some compression of the material. This compression pushes the particles together into a more solid homogeneous mass.

As the material advances toward the die and into an additional zone or zones, this compression is continued and the material is subjected to mixing and mild shear, resulting in heating of the extrudate until the particles are transformed into a dough-like mass. There is still a positive pumping effect in these zones that is somewhat less positive than in the feeding zone.

As the extrudate advances toward a final zone before the die, the extruder barrel becomes completely filled with product. Leakage flow and pressure flow are greatest within this final zone, resulting in higher viscous shearing, yielding maximum heat generation through friction. Heat is generated due to the friction of the particles rubbing against one another and due to the relative motion of the extrudate against screw and head surfaces.

The final die has two major functions. The first of these functions is to offer resistance to the forward flow of the product, thereby creating a condition where leakage flow and pressure flow may occur. Secondly, the die shapes the final product. The flow resistance of the die is the single greatest factor of the heat treatment given to the product because it has the greatest control over the pressure and, therefore, the shear created within the barrel. It is preferred to maintain a pressure at the die within the range of from about 50 to about 2500 psig, more preferably about 150 to about 1500 psig.

In the practice of the method of the present invention, it is preferred to employ a die having an orifice with a diameter within the range of from about 0.5 to about 50 mm, more preferably from about 2 to about 35 mm. Particularly preferred is a die orifice having a diameter within the range of from 3.2 to 3.8 mm.

Typically, foaming of the product occurs immediately after extrusion. This foaming is a result of the moisture or gas within the extrudate changing from a super heated liquid or compressed gaseous state to a gaseous state as the extrudate transfers from the high pressure environment behind the die to the atmospheric environment just outboard of the die openings.

The foamed product is typically extruded in the shape of a solid rod which is then sized, preferably to a substantially cylindrical shape having a diameter of from about 2 to about 35 mm, more preferably from about 4 to about 25 mm, dried by any conventional means, and then processed into completed smoking articles by wrapping with cigarette paper or the like, cutting to desired lengths, and, optionally, attaching a filter.

The article may be extruded into a tube or chamber which communicates with the sizing apparatus and defines the degree to which the article expands upon foaming. The article may then be further expanded after the sizing apparatus by exposure to microwaves or heat which volatilize the moisture or other foaming agent remaining in the sized article, thereby causing it to expand.

While the preferred embodiment of the smoking article has been described in connection with the extrusion of a cylindrical foamed product, other foamed shapes such as sheets, or spiral shapes could be extruded and formed into smoking articles. Variations in the die would be required for the extrusion of non-cylindrical shapes.

The following examples present illustrative but non-limiting embodiments of the present invention.

EXAMPLES

In each of the following examples, a short-time/high-temperature extrusion cooker (Model X-20CF, manufactured by Wenger Manufacturing, Sabetha, Kansas) having a segmented screw and an extruder barrel flighted and segmented to provide five zones that can be independently steam heated or water cooled, was employed.

EXAMPLE 1

The following ingredients were dry blended:

| | |
|---|---|
| 454 g. (5%) | Hydroxypropyl cellulose (Klucel ® HF Hercules) |
| 454 g. (5%) | Carboxymethyl cellulose (CMC 7 HF Hercules) |
| 816.5 g. (9%) | Water |
| 7348.3 g. (81%) | Tobacco dust (60–80 mesh) |

and then fed to the low shear blender where it was admixed with 2540.2 g water, then fed to the extruder and the product extruded under the following conditions:

Extrusion Conditions

| | | | |
|---|---|---|---|
| Zone 1 | 10° C. | Feeder RPM | 12.5 |
| Zone 2 | 60° C. | Low Shear Blender RPM | 300 |
| Zone 3 | 82° C. | Extruder Screw RPM | 400 |
| Zone 4 | 93° C. | Extruder Amps | 20 |
| Zone 5 | 104° C. | Die Orifice | 3.6 mm |
| | | Output | 82 kg./hr. |

EXAMPLE 2

The following ingredients were dry blended:

| | |
|---|---|
| 272.2 g. (3%) | Hydroxypropyl cellulose (Klucel ® HF Hercules) |
| 272.2 g. (3%) | Carboxymethyl cellulose (CMC 7 HF) |
| 852.77 g. (9.4%) | Water |
| 7674.91 g. (84.6%) | Tobacco Dust (60 mesh) |

and then fed to the low shear blender where it is admixed with 2268 g. of water, then fed to the extruder and the product extruded under the following conditions:

Extrusion Conditions

| | | | |
|---|---|---|---|
| Zone 1 | 10° C. | Feeder RPM | 12.5 |
| Zone 2 | 66° C. | Low Shear Blender RPM | 300 |
| Zone 3 | 82° C. | Extruder Screw RPM | 400 |
| Zone 4 | 91° C. | Extruder Amps | 20 |
| Zone 5 | 104° C. | Die Orifice | 3.6 mm |
| | | Output | 82 kg./hr. |

The resulting product was lower in tensile strength than the product of Example 1, but could be extruded and sized to a diameter of 7.20 mm. The density of the finished rod was 0.3 g/cc at a residual moisture content of 12%.

EXAMPLE 3

The following ingredients were dry blended:

| | |
|---|---|
| 1361 g. (15%) | Hydroxyethyl cellulose |
| 771.1 g. (8.5%) | Water |
| 6940.1 g. (76.5%) | Tobacco Dust |

and then fed to the low shear blender where it was admixed with 3129.8 g. of water, then fed to the extruder and the product extruded under the following conditions:

Extrusion Conditions

| | | | |
|---|---|---|---|
| Zone 1 | 13° C. | Feeder RPM | 12.5 |
| Zone 2 | 60° C. | Low Shear Blender RPM | 300 |
| Zone 3 | 77° C. | Extruder Screw RPM | 400 |
| Zone 4 | 110° C. | Extruder Amps | 21 |
| Zone 5 | 104° C. | Die Orifice | 3.6 mm |
| | | Output | 79 kg./hr |

The resulting product was sized to a diameter of 8.0 mm and had a density of 0.25 g/cc at a residual moisture content of 12%.

Higher levels of hydroxyethyl cellulose may be used to achieve a product with lower density and increased strength.

EXAMPLE 4

The following ingredients were dry blended:

| | |
|---|---|
| 1814.4 g. (20%) | Carboxymethyl cellulose (CMC 7 HF) |
| 725.8 g. (8%) | Water |
| 6531.8 g. (72%) | Tobacco Dust (60 mesh) |

and then fed to the low shear blender where it was admixed with 5216.4 g. of water, then fed to the extruder and the product extruded under the following conditions:

Extrusion Conditions

| | | | |
|---|---|---|---|
| Zone 1 | 10° C. | Feeder RPM | 125 |
| Zone 2 | 60° C. | Low Shear Blender RPM | 300 |
| Zone 3 | 82° C. | Extruder Screw RPM | 400 |
| Zone 4 | 93° C. | Extruder Amps | 21 |
| Zone 5 | 104° C. | Die Orifice | 3.6 mm |
| | | Output | 82 kg./hr. |

The resulting product was sized to a diameter of 6.8 mm and had a density of 0.32 g/cc at a residual moisture content of 12%. Rod surface texture was rough and highly porous.

Depending upon extrusion conditions, the carboxymethyl cellulose can be added in amounts as low as 10% by weight of the dry formulation.

EXAMPLE 5

The following ingredients were dry blended:

| | |
|---|---|
| 454 g. (5%) | Hydroxypropyl cellulose (Klucel ® HF Hercules) |
| 272.2 g. (3%) | Carboxymethyl cellulose (CMC 7 HF) |
| 181.4 g. (2%) | Alginic Acid |
| 453.6 g. (5%) | Ethanol |

-continued

| | |
|---|---|
| 771.1 g. (8.5%) | Water |
| 6940.1 g. (76.5%) | Tobacco Dust (60 mesh) |

and then fed to the low shear blender where it was admixed with 1678.3 g. of water, then fed to the extruder and the product extruded under the extrusion conditions of Example 1.

The resulting product had a moisture content of 19% at the die. (Typical formulations without ethanol range from 23% to 30% moisture content at the die.) The product was sized to 8.0 mm diameter and had a density of 0.23 g/cc at a moisture content of 12%.

Reducing the moisture content is advantageous in that if extrudate moisture is lower, the rod is firmer, more easily handled, and requires less drying.

EXAMPLE 6

The following ingredients were dry blended:

| | |
|---|---|
| 464 g. (5%) | Hydroxypropyl cellulose (Klucel ® HF Hercules) |
| 272.2 g. (3%) | Carboxymethyl cellulose (CMC 7 HF) |
| 181.4 g. (2%) | Alginic Acid |
| 181.4 g. (2%) | Citric Acid |
| 798.34 g. (8.8%) | Water |
| 7185.02 g. (79.2%) | Tobacco (35 mesh) |

and then fed to the low shear blender where it was admixed with 2540.2 g. of water, then fed to the extruder and the product extruded under the following conditions:

Extrusion Conditions

| | | | |
|---|---|---|---|
| Zone 1 | 16° C. | Feeder RPM | 125 |
| Zone 2 | 68° C. | Low Shear Blender RPM | 300 |
| Zone 3 | 91° C. | Extruder Screw RPM | 400 |
| Zone 4 | 96° C. | Extruder Amps | 18 |
| Zone 5 | 123° C. | Die Orifice | 3.6 mm |
| | | Extruder Output | 82 kg./hr. |

The resulting product was sized to a diameter of 7.5 mm. The rod density was 0.32 g/cc at a moisture content of 12% and the surface of the rod was rough and porous. Citric acid was used in the above formulation to help soften the tobacco particles.

Previous experimentation showed that material of large particle size (>35 mesh) tended to pierce the rod surface causing a release of steam before expansion due to foaming was complete. As particle size was reduced (<35 mesh), the need for citric acid was eliminated.

EXAMPLE 7

Four sample formulations (7A, 7B, 7C, and 7D) were each prepared by dry blending the following ingredients:

| | |
|---|---|
| 454 g. (5%) | Hydroxypropyl cellulose (Klucel ® HF Hercules) |
| 272.2 g. (3%) | Carboxymethyl cellulose (CMC 7 HF) |
| 181.4 g. (2%) | Alginic Acid |
| 816.5 g. (9%) | Water |
| 7348.3 g. (81%) | Tobacco Dust (60 mesh) |

and then feeding each blend to the low shear blender where it was admixed with 2540.2 g. of water, then fed to the extruder where each sample was extruded under the following conditions:

Constant Extrusion Conditions

| | | | |
|---|---|---|---|
| Feeder RPM | 12.5 | Die Orifice | 3.6 mm |
| Low Shear Blender RPM | 300 | Output | 82 kg./hr |
| Extruder Screw RPM | 400 | | |
| Extruder Amps | 17.5 | | |

Variable Extrusion Conditions

| Sample No. | Zone 1 | Zone 2 | Zone 3 | Zone 4 | Zone 5 |
|---|---|---|---|---|---|
| 7A | 10° C. | 49° C. | 71° C. | 82° C. | 93° C. |
| 7B | 10° C. | 77° C. | 99° C. | 110° C. | 121° C. |
| 7C | 10° C. | 93° C. | 116° C. | 127° C. | 138° C. |
| 7D | 10° C. | 107° C. | 127° C. | 138° C. | 143° C. |

As can be seen from the densities for the four samples:

| Sample No. | Density |
|---|---|
| 7A | .245 g/cc |
| 7B | .250 g/cc |
| 7C | .260 g/cc |
| 7D | .280 g/cc |

the temperature of the formulation in the extruder does not appreciably effect the rod density. Sample 7A, extruded at the lowest temperature, approaches the lower limit for foam formation when steam is employed as the foaming agent. If temperatures and pressures are insufficient for the creation of steam outside the die, foaming cannot take place. At increased temperatures, as in sample 7D, greater steam pressure and reduced film strength on the periphery of the product were observed resulting in increased surface porosity and decreased product diameter.

EXAMPLE 8

Four sample formulations (8A, 8B, 8C, and 8D) were each prepared by dry blending the following ingredients:

| | |
|---|---|
| 454 g. (5%) | Hydroxypropyl cellulose (Klucel ® HF Hercules) |
| 454 g. (5%) | Carboxymethyl cellulose (CMC 7 HF) |
| 816.5 g. (9%) | Water |
| 7348.3 g. (81%) | Tobacco Dust (60 mesh) |

Different amounts of water were added to each dry blend such that the water content of each sample at the die was as follows:

| Sample No. | Total Water Content At Die |
|---|---|
| 8A | 27 wt. % |
| 8B | 29 wt. % |
| 8C | 32 wt. % |
| 8D | 34 wt. % |

Each sample was extruded under the following conditions.

Extrusion Conditions

| | | | |
|---|---|---|---|
| Zone 1 | 60 | Feeder RPM | 12.5 |
| Zone 2 | 140 | Low Shear Blender RPM | 300 |
| Zone 3 | 180 | Extuder Screw RPM | 400 |
| Zone 4 | 200 | Extruder Amps | 21 |
| Zone 5 | 220 | Die Orifice | 3.6 mm |

resulting in products with the following densities:

| Sample No. | Product Density at 12% O.V. |
|---|---|
| 8A | .25 g/cc |
| 8B | .23 g/cc |
| 8C | .23 g/cc |
| 8D | .30 g/cc |

EXAMPLE 9

Sample cigarettes were prepared according to the method of the present invention and submitted for analytical testing. The results are summarized below.

| | Foamed Rod Cigarette | Conventional Cigarette* |
|---|---|---|
| TPM, mg/cigt. | 8.0 | 8.9 |
| FTC Tar, mg/cigt. | 6.5 | 7.3 |
| Nicotine, mg/cigt. | 0.45 | 0.59 |
| Water, mg/cigt. | 1.0 | 1.0 |
| Puff Count | 8.4 | 7.9 |
| Tobacco Density, g/cc | 0.22 | 0.25 |
| Dilution, % | 35 | 34 |
| Total RTD, in. of $H_2O$ | 5.5 | 5.1 |

*The conventional cigarettes tested were made from a similar tobacco blend in shredded form.

As can be seen, the structural characteristics of a foamed tobacco rod do not affect its ability to perform like a conventional cigarette. The foam structure permits a greater degree of freedom in design, thus permitting a lower weight rod to be produced with properties equivalent to a conventional cigarette.

We claim:

1. A method of making a foamed, extruded, tobacco-containing smoking article, comprising the steps of:
   (a) dry blending from about 5 to about 98 wt. % of tobacco particles having a particle size of up to about 5 mesh and an OV value of from about 3 to about 20%, with from 0 to about 60 wt. % of a filler having a particle size of up to about 350 μm, and from about 2 to about 40 wt. % of a cellulosic binder selected from the group consisting of hydroxypropyl cellulose, carboxymethyl cellulose, and its sodium, potassium and ammonium salts, cross-linked carboxymethyl cellulose, and its sodium, potassium and ammonium salts, hydroxyethyl cellulose, ethyl hydroxyethyl cellulose, hydroxypropyl methyl cellulose, methyl cellulose, ethyl cellulose, and mixtures thereof;
   (b) admixing the dry blend with water to form a wet blend containing from about 15 to about 50 wt. % of water; then
   (c) extruding the wet blend from step (b) under extrusion conditions of temperature and pressure such that as the wet blend is extruded the moisture in said blend is converted to steam, thereby foaming the article.

2. The method of claim 1 wherein the filler is selected from the group consisting of calcium carbonate, magnesium carbonate, calcium oxide, magnesium oxide, calcium hydroxide, magnesium hydroxide, alumina, hydrated alumina, clay, silica and mixtures thereof.

3. The method of claim 1 including adding in step (a) a compound selected from the group consisting of pectin and its sodium, potassium and ammonium salts, guar, carageenan, oxycellulose, polyvinyl alcohol, vinyl maleic anhydride polymer, vinyl maleic acid polymer and its sodium, potassium, and ammonium salts, microcrystalline cellulose, fibrous cellulose and mixtures thereof, such that the total amount of the compound and the cellulosic binder is within the range of from about 2 to about 40 wt. %.

4. The method of claim 1 including as a further step:
   (d) sizing the extrudate from step (c) to a substantially cylindrical shape having a diameter of from about 2 to about 35 mm.

5. The method of claim 1 including, in step (a), from about 0.1 to about 15 wt. % of a polyfunctional acid.

6. The method of claim 5 wherein the polyfunctional acid is citric acid.

7. The method of claim 1 including, in step (a), from about 0.1 to about 40 wt. % of a stiffening agent selected from the group consisting of alginic acid, pectinic acid, chitosan, their water soluble salts, and mixtures thereof.

8. The method of claim 1 including, in step (a), from about 2 to about 40 wt. % of an alcohol selected from the group consisting of ethanol, methanol, isopropanol, n-propanol, and mixtures thereof.

9. The method of claim 1 wherein in step (a) the tobacco particles comprise from about 50 to about 98 wt. %.

10. A smoking article produced according to the method of claim 1.

11. A substantially cylindrical, foamed, extruded, tobacco-containing smoking article comprising from about 5 to about 98 wt. % of tobacco particles having a particle size of up to about 5 mesh, from 0 to about 60 wt. % of a filler having a particle size of up to about 350 μm, from about 2 to about 40 wt. % of a cellulosic binder selected from the group consisting of hydroxypropyl cellulose, carboxymethyl cellulose, and its sodium, potassium and ammonium salts, cross-linked carboxymethyl cellulose, and its sodium, potassium and ammonium salts, hydroxyethyl cellulose, ethyl hydroxyethyl cellulose, hydroxypropyl methyl cellulose, methyl cellulose, ethyl cellulose, and mixtures thereof, and from about 5 to about 20 wt. % water, said article having a density within the range of from about 0.05 to about 1.5 g/cc.

12. The smoking article of claim 11 wherein the filler is selected from the group consisting of calcium carbonate, magnesium carbonate, calcium oxide, magnesium oxide, calcium hydroxide, magnesium hydroxide, alumina, hydrated alumina, clay, silica and mixtures thereof.

13. The smoking article of claim 11 including a compound selected from the group consisting of pectin and its sodium, potassium and ammonium salts, guar, carageenan, oxycellulose, polyvinyl alcohol, vinyl maleic anhydride polymer, vinyl maleic acid polymer and its sodium, potassium, and ammonium salts, microcrystalline cellulose, fibrous cellulose and mixtures thereof, such that the total amount of the compound and the cellulosic binder is within the range of from about 2 to about 40 wt. %.

14. The smoking article of claim 11 including from about 0.1 to about 15 wt. % of a polyfunctional acid.

15. The smoking article of claim 14 wherein the polyfunctional acid is citric acid.

16. The smoking article of claim 11 wherein the tobacco particles comprise about 50 to about 98 wt. % of the article.

17. The smoking article of claim 11 including from about 0.1 to about 40 wt. % of a cross-linked stiffening agent.

* * * * *